US011773682B2

(12) United States Patent
Al-Mumen et al.

(10) Patent No.: US 11,773,682 B2
(45) Date of Patent: Oct. 3, 2023

(54) TIEBACK ASSEMBLIES WITH CIRCULATING SUBS FOR WELL INTERVENTION

(71) Applicant: Saudi Arabian Oil Company, Dhahran (SA)

(72) Inventors: Adib A. Al-Mumen, Dammam (SA); Abdulaziz S. Al Mutawa, Dammam (SA)

(73) Assignee: Saudi Arabian Oil Company, Dhahran (SA)

( * ) Notice: Subject to any disclaimer, the term of this patent is extended or adjusted under 35 U.S.C. 154(b) by 28 days.

(21) Appl. No.: 17/148,863

(22) Filed: Jan. 14, 2021

(65) Prior Publication Data

US 2022/0220823 A1 Jul. 14, 2022

(51) Int. Cl.

| | |
|---|---|
| ***E21B 33/13*** | (2006.01) |
| ***E21B 34/06*** | (2006.01) |
| ***E21B 47/10*** | (2012.01) |

(52) U.S. Cl.

CPC ..... *E21B 33/13* (2013.01); *E21B 34/06* (2013.01); *E21B 47/10* (2013.01); *E21B 2200/05* (2020.05)

(58) Field of Classification Search

CPC ..... E21B 33/13; E21B 34/06; E21B 34/08; E21B 47/10; E21B 2200/05; E21B 17/04; E21B 2200/04; E21B 43/10; F16L 17/08

See application file for complete search history.

(56) References Cited

U.S. PATENT DOCUMENTS

| | | | |
|---|---|---|---|
| 6,155,350 | A | 12/2000 | Melenyzer |
| 6,328,111 | B1 | 12/2001 | Bearden et al. |
| 10,358,888 | B2 | 7/2019 | Al-AbdulJabbar et al. |
| 2007/0246217 | A1 | 10/2007 | Tulloch et al. |
| 2009/0322030 | A1 | 12/2009 | Pallini, Jr. et al. |

(Continued)

FOREIGN PATENT DOCUMENTS

| | | | |
|---|---|---|---|
| WO | 2008127836 | A1 | 10/2008 |

OTHER PUBLICATIONS

Notification of Transmittal of the International Search Report and the Written Opinion of the International Searching Authority, or the Declaration dated Mar. 16, 2022 pertaining to International application No. PCT/US2022/01 1078 filed Jan. 4, 2022, 14 pages.

(Continued)

*Primary Examiner* — Caroline N Butcher

(74) *Attorney, Agent, or Firm* — DINSMORE & SHOHL LLP

(57) ABSTRACT

A tieback assembly for insertion into a wellbore may include a tieback stem seal, a check valve, and a circulating sub. The tieback stem seal may be engaged into a tieback receptacle of a liner in the wellbore and may isolate an annular space of the wellbore. The circulating sub may pass kill fluid from the tieback assembly into the annular space of the wellbore. The check valve may control a flow of fluid. A method of isolating an annular space of a wellbore may include inserting a tieback assembly into the wellbore, engaging the tieback stem seal of the tieback assembly at a tieback receptacle of a liner in the wellbore, passing a kill fluid into the annular space of the wellbore, and displacing an annulus fluid in the annular space of the wellbore with the kill fluid to isolate the annular space of the wellbore.

19 Claims, 2 Drawing Sheets

(56) References Cited

U.S. PATENT DOCUMENTS

| | | | | |
|---|---|---|---|---|
| 2012/0175108 | A1* | 7/2012 | Foubister | E21B 23/02 166/126 |
| 2015/0252650 | A1 | 9/2015 | Gaspard et al. | |
| 2016/0312574 | A1* | 10/2016 | Moffitt | E21B 33/14 |
| 2017/0218710 | A1* | 8/2017 | Zhou | E21B 34/06 |
| 2018/0100380 | A1* | 4/2018 | El Nekhily | E21B 47/10 |
| 2018/0187511 | A1* | 7/2018 | Gaspard | E21B 34/06 |
| 2019/0071935 | A1* | 3/2019 | Elbadawy | E21B 17/05 |

OTHER PUBLICATIONS

Notification of Transmittal of the International Search Report and the Written Opinion of the International Searching Authority, or the Declaration dated Mar. 25, 2022 pertaining to International application No. PCT/US2022/011078 filed Jan. 4, 2022, 15 pages.

Communication in Cases for Which No Other Form is Applicable dated Mar. 22, 2022 pertaining to International application No. PCT/US2022/011078 filed Jan. 4, 2022, 1 page.

* cited by examiner

TIEBACK ASSEMBLIES WITH CIRCULATING SUBS FOR WELL INTERVENTION

BACKGROUND

Field

The present disclosure relates to assemblies and methods for insertion into a wellbore for the isolation of an annular space of the wellbore.

Technical Background

Oil and gas wells commonly require maintenance or repair during the life of the well. Well intervention generally falls into one of two categories, light or heavy. In light well interventions, tools or sensors may be lowered into a live well while pressure is contained at the surface (i.e., production is not stopped). In heavy well interventions, production of the well may be stopped prior to the necessary maintenance or repair. Heavy well interventions may require removing the wellhead and other pressure barriers from the well to allow full access to the wellbore. Accordingly, heavy well interventions may require isolating the wellbore such that the required maintenance or repair may take place.

SUMMARY

In hydrocarbon production, a wellbore may be drilled into a hydrocarbon-rich geological formation. While drilling or after the wellbore is completely drilled, a completion system may be installed to secure the wellbore in preparation for production. The completion system may include a series of casings or liners cemented in the wellbore to help control the well and maintain well integrity.

Throughout the life of the well, maintenance or repair may be necessary. Completion system components may wear out during the life of the well, requiring maintenance or repair. For example, casings or liners may develop leaks, such as shallow casing leaks near the surface. As another example, multiple hydrocarbon-producing regions along the wellbore may experience crossflow, where instead of hydrocarbons flowing to the surface, they flow from one hydrocarbon-producing region to a second hydrocarbon-producing region. To solve the problems associated with leaks and crossflow, well intervention may be necessary to maintain or repair equipment. Depending on the type of well intervention, it may be necessary to kill the well (i.e., stop the well from producing by preventing hydrocarbons from flowing into the wellbore) and isolate the annular space of the wellbore. Killing the well and isolating the annular space of the wellbore may be costly, as the well is not actively producing hydrocarbons. Therefore, it is important that the well be killed quickly and efficiently such that the necessary well intervention may take place.

Accordingly, there is an ongoing need for assemblies and methods for isolating annular spaces of wellbores to increase the efficiency of the well intervention process. The present disclosure is directed to tieback assemblies and methods for insertion of tieback assemblies into wellbores for isolating annular spaces of wellbores for well intervention. More specifically, the present disclosure may allow for the pumping of a kill fluid down boreholes and for the circulating of the kill fluid into the annular space where a shallow caking leaks or crossflow is occurring. In the present disclosure tieback assemblies including tieback stem seals, check valves, and circulating subs may be used to increase the efficiency of isolating annular spaces of wellbores for well intervention. As further described herein, well isolation may be reached efficiently due to the assemblies and methods of the present disclosure.

According to one or more aspects of the present disclosure, a method of isolating an annular space of a wellbore may include inserting a tieback assembly into the wellbore. The tieback assembly may include a tieback stem seal at a downhole end of the tieback assembly, a check valve disposed vertically above the tieback stem seal, and a circulating sub disposed vertically above the check valve. The method may also include engaging the tieback stem seal of the tieback assembly at a tieback receptacle of a liner in the wellbore, passing a kill fluid into the tieback assembly, through the circulating sub, and into the annular space of the wellbore, and displacing an annulus fluid in the annular space of the wellbore with the kill fluid to isolate the annular space of the wellbore.

According to one or more other aspects of the present disclosure, a tieback assembly for insertion into a wellbore may include a tieback stem seal, a check valve, and a circulating sub. The tieback stem seal may define a downhole end of the tieback assembly. The circulating sub may define an uphole end of the tieback assembly. The check valve may be positioned between the tieback stem seal and the circulating sub. The tieback stem seal may be operable to be engaged into a tieback receptacle of a liner in the wellbore and to isolate an annular space of the wellbore. The circulating sub may be operable to pass kill fluid from the tieback assembly, through the circulating sub, and into the annular space of the wellbore when activated. The check valve may be operable to control a flow of fluid either through the tieback assembly or out of the circulating sub.

Additional features and advantages of the technology described in this disclosure will be set forth in the detailed description which follows, and in part will be readily apparent to those skilled in the art from the description or recognized by practicing the technology as described in this disclosure, including the detailed description which follows, the claims, as well as the appended drawings.

BRIEF DESCRIPTION OF THE DRAWINGS

The following detailed description of specific embodiments of the present disclosure can be best understood when read in conjunction with the following drawings, where like structure is indicated with like reference numerals and in which.

Reference will now be made in greater detail to various embodiments of the present disclosure, some embodiments of which are illustrated in the accompanying drawings. Whenever possible, the same reference numerals will be used throughout the drawings to refer to the same or similar parts.

DETAILED DESCRIPTION

Figure 1:
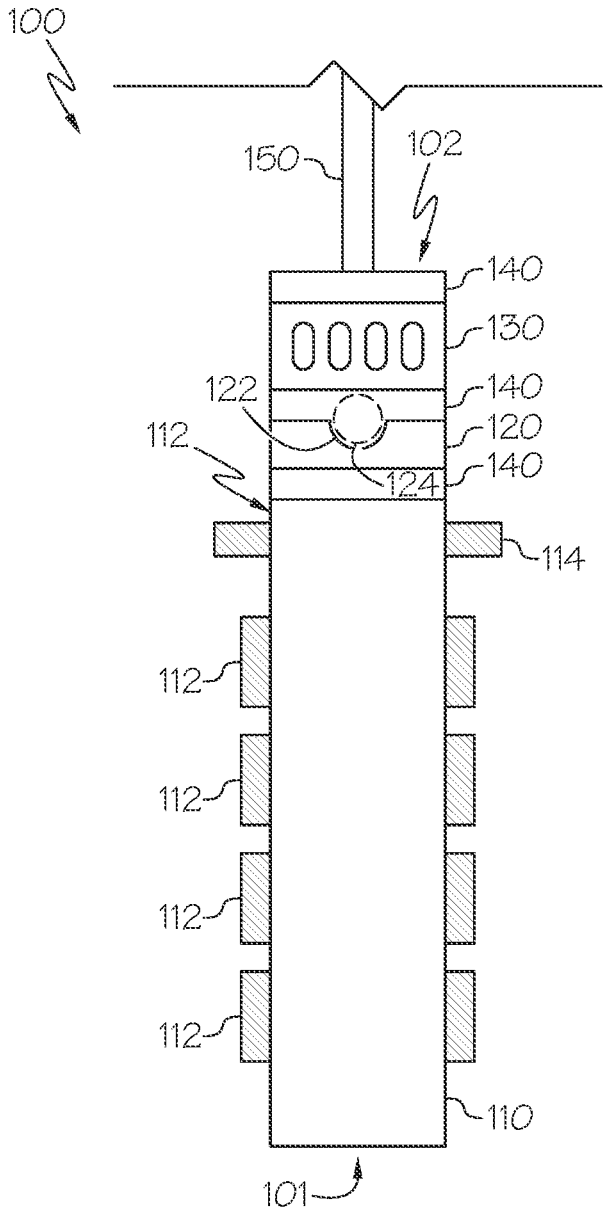
FIG. 1 schematically depicts a tieback assembly engaged at a tieback receptacle of a liner in a wellbore, according to one or more embodiments shown and described in this disclosure.

The present disclosure is directed to tieback assemblies for insertion into a wellbore for isolating annular spaces of wellbores for well intervention. In particular, the tieback assemblies of the present disclosure may include a tieback stem seal, a check valve, and a circulating sub. Referring to FIG. 1, one embodiment of a tieback assembly is schematically depicted. The tieback assembly may include a tieback stem seal, a check valve, and a circulating sub. The tieback stem seal may define a downhole end of the tieback assembly. The circulating sub may define an uphole end of the tieback assembly. The check valve may be positioned between the tieback stem seal and the circulating sub. The tieback stem seal may be operable to be engaged into a tieback receptacle of a liner in the wellbore and to isolate an annular space of the wellbore. The circulating sub may be operable to pass kill fluid from the tieback assembly, through the circulating sub, and into the annular space of the wellbore when activated. The check valve may be operable to control a flow of fluid either through the tieback assembly or out of the circulating sub.

Figure 2:
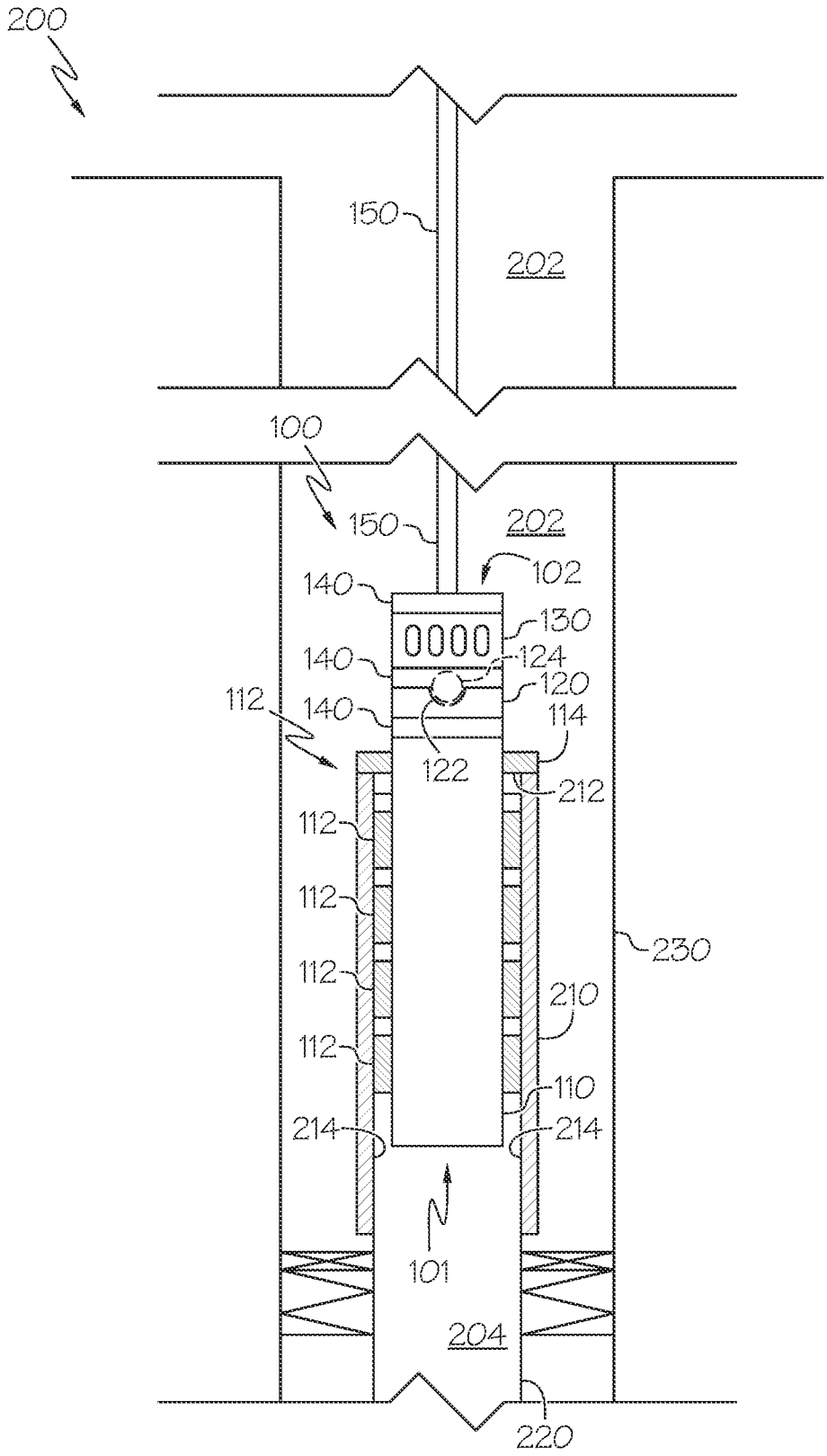
FIG. 2 schematically depicts a tieback assembly, according to one or more embodiments shown and described in this disclosure.

The present disclosure is also directed to methods of isolating annular spaces of wellbores. Referring to FIG. 2, the methods may include inserting a tieback assembly into the wellbore, engaging the tieback stem seal of the tieback assembly at a tieback receptacle of a liner in the wellbore, passing a kill fluid into the tieback assembly, through the circulating sub, and into the annular space of the wellbore, and displacing an annulus fluid in the annular space of the wellbore with the kill fluid to isolate the annular space of the wellbore. The tieback assembly may have any of the features as described in the preceding paragraph.

The various apparatuses and methods for isolating an annular space of a wellbore may provide increased efficiency for the isolation of the annular space of the wellbore to conventional apparatuses and processes for isolating an annular space of a wellbore. That is, the various apparatuses and methods may allow for quick and efficient isolation of the annular space such that well intervention may be performed as quickly as possible. The apparatuses and methods of the present disclosure may allow the time that the well is killed, and therefore, not producing hydrocarbons, to be minimized.

As used throughout the present disclosure, the term "wellbore" may refer to a drilled hole or borehole, including an openhole or uncased portion of the well. Borehole may refer to an inside diameter of the wellbore wall (i.e., the rock face that bounds the drilled hole). As used throughout the present disclosure, the term "annular space" may refer to space surrounding one cylindrical object placed inside another, such as the space surrounding a tubular object (e.g., coiled tubing) placed in a wellbore.

As used throughout the present disclosure, the term "tieback stem seal" may refer to a tieback assembly component having one or more seals that may be engaged into a tieback receptacle of a liner in a wellbore to isolate the liner from an annular space of the uphole casing.

As used throughout the present disclosure, the term "check valve" may refer to mechanical device that permits fluid to flow or pressure to act in one direction only, and/or that may selectively block flow in a direction.

As used throughout the present disclosure, the term "circulating sub" may refer to a downhole tool typically used with motors or assemblies that may restrict the allowable fluid-circulation rates. The circulating sub may allow a higher circulation rate to be established by opening a path to the annulus in the top section of the tool string.

As used throughout the present disclosure, the term "crossover" may refer to a subassembly used to enable two components (e.g., a circulating sub and a check valve or a check valve and a tieback stem seal) with different thread types, connection types, or sizes to be connected.

Referring to FIGS. 1 and 2, a tieback assembly 100 for insertion into a wellbore 200 may include a tieback stem seal 110, a check valve 120, and a circulating sub 130. The tieback stem seal 110 may define a downhole end 101 of the tieback assembly 100. The circulating sub 130 may define an uphole end 102 of the tieback assembly 100. The check valve 120 may be positioned between the tieback stem seal 110 and the circulating sub 130. The tieback stem seal 110 may be operable to be engaged into a tieback receptacle 210 of a liner 220 in the wellbore 200 and to isolate an annular space 202 of the wellbore 200. The annular space 202 of the wellbore 200 may be the space between a casing 230 and any interior components, such as the tieback assembly 100. The circulating sub 130 may be operable to pass kill fluid from the tieback assembly 100, through the circulating sub 130, and into the annular space 202 of the wellbore 200 when activated. The check valve 120 may be operable to control a flow of fluid either through the tieback assembly 100 or out of the circulating sub 130.

The tieback stem seal 110 may include a seal 112 around the tieback stem seal 110 along the length of the tieback stem seal. The seal 112 may be operable to isolate the annular space 202 of the wellbore 200. The seal 112 may include a metal-to-metal seal or an elastomeric seal. The tieback stem seal 110 may be any conventional or yet to be developed tieback stem seal 110. For an example of a tieback stem seal 110 and for further description of how a tieback stem seal 110 may operate, reference is made to U.S. Pat. No. 10,358,888 B2.

An uphole end 112 of the tieback stem seal 110 may include an outer diameter 114 larger than an inner diameter of the tieback receptacle 210 of the liner 220. Those skilled in the art may refer to the outer diameter of the tieback stem seal 110 that is larger than the inner diameter of the tieback receptacle 210 of the liner 220 as a "no-go profile." Engaging the tieback assembly 100 at the tieback receptacle 210 of the liner 220 in the wellbore 200 may include inserting a length of the tieback stem seal 110 until the no-go profile engages the tieback receptacle 210 of the liner 220. This interaction between the outer diameter 114 of the uphole end 112 of the tieback stem seal 110 and the inner diameter of the tieback receptacle 210 of the liner 220 may form a metal-to-metal seal.

The check valve 120 may be positioned directly above the tieback stem seal 110 and directly below the circulating sub 130. The check valve 120 may be operable to close and prevent upward fluid flow when the tieback stem seal 110 engaged into the tieback receptacle 210 of the liner 220 in the wellbore 200. According to one or more embodiments, the check valve 120 may be a flapper valve. As used in the present disclosure, a "flapper valve" may refer to a type of check valve 120 having a spring-loaded plate (i.e., flapper) that may be pumped through, generally in the downhole direction, but may close if fluid attempts to flow back through the plate, generally in the uphole direction, along a drillstring or coiled tubing to the surface.

The check valve 120 may further include a ball seat 122. The ball seat 122 may be operable to catch a ball 124 and direct the flow of fluid out of the circulating sub 130 and into the annular space 202 of the wellbore 200. For an example of a ball seat 122 and for further description of how a ball seat 122 may operate, reference is made to U.S. Pat. No. 6,155,350 A.

As previously discussed, the circulating sub 130 may define an uphole end 102 of the tieback assembly 100. The circulating sub 130 may be operable to pass kill fluid from the tieback assembly 100, through the circulating sub 130, and into the annular space 202 of the wellbore 200 when activated. The circulating sub 130 may be activated by inserting or dropping a ball 124 from the surface and pumping the ball 124 down to the ball seat 122. Once the ball 124 is set in the ball seat 122, pressure may be applied to force the ball 124 into the ball seat 122, which may activate the circulating sub 130. When the circulating sub 130 is activated, a portion of kill fluid may continue to pass through the tieback assembly 100 and into the liner. The circulating sub 130 may allow a higher circulation rate to be established by opening a path to the annular space 202 above the liner.

The tieback assembly 100 may further include coiled tubing 150. The coiled tubing 150 may be in fluid communication with the surface and the tieback assembly 100. As one skilled in the art will appreciate, coiled tubing 150 may be a continuous length of pipe wound on a spool. The coiled tubing 150 may be attached or coupled to the tieback assembly 100 such that the tieback assembly 100 may be lowered into the wellbore 200. The coiled tubing 150 may be operable to pass kill fluid from the surface, into the tieback assembly 100, through the circulating sub 130, and into the annular space 202 of the wellbore 200.

The tieback assembly 100 may further include one or more crossovers 140 to connect tieback assembly 100 components having different thread or connection types. The one or more crossovers 140 may be positioned between the tieback stem seal 110 and the check valve 120, the check valve 120 and the circulating sub 130, or both. The one or more crossovers 140 may have an internal void such that fluid (e.g., kill fluid) may be pumped from the coiled tubing 150 and along the internal bore of the tieback assembly 100.

It is contemplated that other components or tools may be added to the tieback assembly 100 as necessary. Depending on the wellbore 200, liner, type of well intervention, etc. one skilled in the art would recognize that additional components or tools may be beneficial to add to the tieback assembly 100 of the present disclosure.

Referring again to FIG. 2, a method of isolating the annular space 202 of the wellbore 200 may include inserting the tieback assembly 100 into the wellbore 200, engaging the tieback stem seal 110 of the tieback assembly 100 at the tieback receptacle 210 of the liner 220 in the wellbore 200, passing a kill fluid into the tieback assembly 100, through the circulating sub 130, and into the annular space 202 of the wellbore 200, and displacing an annulus fluid in the annular space 202 of the wellbore 200 with the kill fluid to isolate the annular space 202 of the wellbore 200.

The method of isolating the annular space 202 of the wellbore 200 may further include attaching coiled tubing 150 to the tieback assembly 100 and running the tieback assembly 100 using coiled tubing 150. As one skilled in the art will appreciate, "running" may refer to the process of lowering a component down the wellbore to a certain location. The coiled tubing 150 may be attached to the tieback assembly 100 prior to inserting the tieback assembly 100 into the wellbore 200. The coiled tubing 150 may fluidly couple the tieback assembly 100 to the surface, such that the kill fluid may be passed from the surface to the annular space 202 of the wellbore 200.

As previously discussed in the present disclosure, the uphole end 112 of the tieback stem seal 110 may include an outer diameter 114 larger than an inner diameter 212 of the tieback receptacle 210 of the liner 220 (i.e., a no-go profile). Engaging the tieback assembly 100 at the tieback receptacle 210 of the liner 220 in the wellbore 200 may include inserting a length of the tieback stem seal 110 until the no-go profile engages the tieback receptacle 210 of the liner 220. This coupling between the uphole end 112 of the tieback stem seal 110 and the tieback receptacle 210 of the liner 220 may create a metal-to-metal seal isolating the annular space 202 of the wellbore 200.

In one or more embodiments, the tieback stem seal 110 may include a seal 110 around the tieback stem seal 110 along the length of the tieback stem seal 110. The method of isolating the annular space 202 of the wellbore 200 may further include engaging the seal 110 with an interior surface 214 of the tieback receptacle 210 of the liner 220. The seal 110 may include a metal-to-metal seal or an elastomeric seal.

The method of isolating the annular space 202 of the wellbore 200 may further include closing the check valve 120 after engaging the tieback stem seal 110 of the tieback assembly 100 at the tieback receptacle 210 of the liner 220 in the wellbore 200. The check valve 120 may be opened while engaging the tieback stem seal 110 of the tieback assembly 100 at the tieback receptacle 210 such that kill fluid may be pumped below the tieback stem seal 110 until a borehole 204 below the tieback stem seal 110 is killed (i.e., isolated) and production has stopped. The ball 124 may then be dropped down the wellbore 200 and into the ball seat 122, which may close the check valve 120. After closing the check valve 120, kill fluid may be bullheaded into the annular space 202 of the wellbore 200. The circulating sub 130 may be operable to passing a kill fluid into the tieback assembly 100, through the circulating sub 130, and into the annular space 202 of the wellbore 200. As the kill fluid is passed into the annular space 202, any annular fluid, such as hydrocarbons or air, may be displaced back into the formation. The kill fluid may be any fluid having a density high enough to produce a hydrostatic pressure at the point of influx in a wellbore 200 that is sufficient to shut off flow from a hydrocarbon-producing region into the wellbore 200.

In well interventions to fix a leak, it may be important to identify a leak depth prior to deploying and installing the tieback assembly 100. Similarly, in well interventions to reduce or eliminate crossflow, it may be important to identify the depth of the multiple hydrocarbon-producing regions prior to deploying and installing the tieback assembly 100. The method of isolating the annular space 202 of the wellbore 200 may further include identifying the leak depth or depth of the multiple hydrocarbon-producing regions in the wellbore 200. Identifying the leak depth or depth of the multiple hydrocarbon-producing regions in the wellbore 200 may be accomplished by running a multi-finger caliper log, a noise log, a temperature survey, or any other known or yet to be developed method. If the leak depth or depth of the multiple hydrocarbon-producing regions is identified to be above the existing liner depth, the tieback assembly 100 may be used to isolate the annular space 202 of the wellbore 200 to kill the well while isolating the leak or stopping any crossflow between the multiple hydrocarbon-producing regions.

After the annular space 202 of the wellbore 200 is isolated, the method may further include installing downhole plugs to isolate a reservoir section of the wellbore 200 from a shallow leak once the annular space 202 of the wellbore 200 is isolated. Alternatively or additionally, the method may further include installing other equipment to isolate multiple hydrocarbon-producing regions such that any crossflow may be reduced or eliminated.

One or more aspects of the present disclosure are described herein. A first aspect of the present disclosure may include a method of isolating an annular space of a wellbore, the method comprising inserting a tieback assembly into the wellbore. The tieback assembly may comprise a tieback stem seal at a downhole end of the tieback assembly, a check valve disposed vertically above the tieback stem seal, and a circulating sub disposed vertically above the check valve. The method may further comprise engaging the tieback stem seal of the tieback assembly at a tieback receptacle of a liner in the wellbore, passing a kill fluid into the tieback assembly, through the circulating sub, and into the annular space of the wellbore, and displacing an annulus fluid in the annular space of the wellbore with the kill fluid to isolate the annular space of the wellbore.

A second aspect of the present disclosure may include the first aspect, further comprising attaching coiled tubing to the tieback assembly prior to inserting the tieback assembly into the wellbore and running the tieback assembly using coiled tubing.

A third aspect of the present disclosure may include the second aspect, where the coiled tubing fluidly couples the tieback assembly to the surface, such that the kill fluid may be passed from the surface to the annular space of the wellbore.

A fourth aspect of the present disclosure may include any one of the first through third aspects, where an uphole end of the tieback stem seal may comprise a no-go profile having an outer diameter larger than an inner diameter of the tieback receptacle of the liner. The method may further comprise engaging the tieback assembly at the tieback receptacle of the liner in the wellbore, which may comprise inserting a length of the tieback stem seal until the no-go profile engages the tieback receptacle of the liner.

A fifth aspect of the present disclosure may include the fourth aspect, where the uphole end of the tieback stem seal and the tieback receptacle of the liner may form a metal-to-metal seal isolating the annular space of the wellbore.

A sixth aspect of the present disclosure may include any one of the first through fifth aspects, where the tieback stem seal may comprise a seal around the tieback stem seal along the length of the tieback stem seal, and where the method may further comprise engaging the seal with an interior surface of the tieback receptacle of the liner.

A seventh aspect of the present disclosure may include the sixth aspect, where the seal may comprise a metal-to-metal seal or an elastomeric seal.

An eighth aspect of the present disclosure may include any one of the first through seventh aspects, further comprising closing the check valve after engaging the tieback stem seal of the tieback assembly at the tieback receptacle of the liner in the wellbore.

A ninth aspect of the present disclosure may include any one of the first through eighth aspects, further comprising identifying a leak depth in the wellbore prior to inserting the tieback assembly into the wellbore and isolating the annular space of the wellbore.

A tenth aspect of the present disclosure may include any one of the first through ninth aspects, further comprising installing downhole plugs to isolate a reservoir section of the wellbore from a shallow leak once the annular space of the wellbore is isolated.

An eleventh aspect of the present disclosure may include a tieback assembly for insertion into a wellbore, the tieback assembly comprising a tieback stem seal, a check valve, and a circulating sub. The tieback stem seal may define a downhole end of the tieback assembly. The circulating sub may define an uphole end of the tieback assembly. The check valve may be positioned between the tieback stem seal and the circulating sub. The tieback stem seal may be operable to be engaged into a tieback receptacle of a liner in the wellbore and to isolate an annular space of the wellbore. The circulating sub may be operable to pass kill fluid from the tieback assembly, through the circulating sub, and into the annular space of the wellbore when activated. The check valve may be operable to control a flow of fluid either through the tieback assembly or out of the circulating sub.

A twelfth aspect of the present disclosure may include the eleventh aspect, where the tieback stem seal may comprise a seal around the tieback stem seal along a length of the tieback stem seal, and the seal may be operable to isolate the annular space of the wellbore.

A thirteenth aspect of the present disclosure may include the twelfth aspect, where the seal may comprise a metal-to-metal seal or an elastomeric seal.

A fourteenth aspect of the present disclosure may include any one of the eleventh through thirteenth aspects, where the check valve may be operable to close and prevent upward fluid flow when the tieback stem seal is engaged into the tieback receptacle of the liner in the wellbore.

A fifteenth aspect of the present disclosure may include any one of the eleventh through fourteenth aspects, where the check valve may be a flapper valve.

A sixteenth aspect of the present disclosure may include any one of the eleventh through fifteenth aspects, where the check valve may further comprise a ball seat operable to catch a ball and direct the flow of fluid out of the circulating sub and into the annular space of the wellbore.

A seventeenth aspect of the present disclosure may include any one of the eleventh through sixteenth aspects, where the check valve may be positioned directly above the tieback stem seal and directly below the circulating sub.

An eighteenth aspect of the present disclosure may include any one of the eleventh through seventeenth aspects, further comprising coiled tubing in fluid communication with the surface and the tieback assembly.

A nineteenth aspect of the present disclosure may include the eighteenth aspect, where the coiled tubing may be operable to pass kill fluid from the surface, into the tieback assembly, through the circulating sub, and into the annular space of the wellbore.

A twentieth aspect of the present disclosure may include any one of the eleventh through nineteenth aspects, further comprising one or more crossovers positioned between the tieback stem seal and the check valve, the check valve and the circulating sub, or both to connect tieback assembly components having different thread or connection types.

It is noted that one or more of the following claims utilize the term "where" as a transitional phrase. For the purposes of defining the present technology, it is noted that this term is introduced in the claims as an open-ended transitional phrase that is used to introduce a recitation of a series of characteristics of the structure and should be interpreted in like manner as the more commonly used open-ended preamble term "comprising."

Having described the subject matter of the present disclosure in detail and by reference to specific embodiments, it is noted that the various details described in this disclosure should not be taken to imply that these details relate to elements that are essential components of the various embodiments described in this disclosure, even in cases where a particular element is illustrated in each of the drawings that accompany the present description. Rather, the claims appended hereto should be taken as the sole representation of the breadth of the present disclosure and the corresponding scope of the various embodiments described in this disclosure. Further, it will be apparent that modifications and variations are possible without departing from the scope of the appended claims.

The invention claimed is:

1. A method of isolating an annular space of a wellbore, the method comprising:

inserting a tieback assembly into the wellbore, the tieback assembly comprising a tieback stem seal at a downhole end of the tieback assembly, an uphole end of the tieback stem seal comprising a no-go profile having an outer diameter larger than an inner diameter of a tieback receptacle of a liner in the wellbore, a check valve disposed vertically above the tieback stem seal, and a circulating sub disposed vertically above the check valve, engaging the tieback stem seal of the tieback assembly at the tieback receptacle of the liner in the wellbore by inserting a length of the tieback stem seal until the no-go profile engages the tieback receptacle of the liner and a downhole portion of the tieback stem seal extends into the tieback receptacle;

passing a kill fluid into the tieback assembly, through the circulating sub, and into the annular space of the wellbore; and displacing an annulus fluid in the annular space of the wellbore with the kill fluid to isolate the annular space of the wellbore;

wherein the tieback stem seal comprises a plurality of seals around the tieback stem seal, the plurality of seals extending along the length of the tieback stem seal from the uphole end of the tieback stem seal to the downhole portion of the tieback stem seal on the downhole end of the tieback assembly, and where the method further comprises engaging the tieback stem seal with an interior surface of the tieback receptacle of the liner.

2. The method of claim 1, further comprising attaching coiled tubing to the tieback assembly prior to inserting the tieback assembly into the wellbore and running the tieback assembly using coiled tubing.

3. The method of claim 2, where the coiled tubing fluidly couples the tieback assembly to the surface, such that the kill fluid may be passed from the surface to the annular space of the wellbore.

4. The method of claim 1, where the uphole end of the tieback stem seal and the tieback receptacle of the liner form a metal-to-metal seal isolating the annular space of the wellbore.

5. The method of claim 1, where the tieback stem seal comprises at least one of the plurality of seals around the tieback stem seal along the length of the tieback stem seal, and where the method further comprises engaging the seal with an interior surface of the tieback receptacle of the liner.

6. The method of claim 5, where the seal comprises a metal-to-metal seal or an elastomeric seal.

7. The method of claim 1, further comprising closing the check valve after engaging the tieback stem seal of the tieback assembly at the tieback receptacle of the liner in the wellbore.

8. The method of claim 1, further comprising identifying a leak depth in the wellbore prior to inserting the tieback assembly into the wellbore and isolating the annular space of the wellbore.

9. The method of claim 1, further comprising installing downhole plugs to isolate a reservoir section of the wellbore from a shallow leak once the annular space of the wellbore is isolated.

10. A tieback assembly for insertion into a wellbore and engaging a tieback receptacle of a liner in the wellbore, the tieback assembly comprising a tieback stem seal, a check valve, and a circulating sub, where:

the tieback stem seal defines a downhole end of the tieback assembly, an uphole end of the tieback stem seal comprising a no-go profile having an outer diameter larger than an inner diameter of the tieback receptacle of the liner;

the circulating sub defines an uphole end of the tieback assembly;

the check valve is positioned between the tieback stem seal and the circulating sub;

the tieback stem seal is operable to be engaged into the tieback receptacle of the liner in the wellbore and to isolate an annular space of the wellbore by inserting a length of the tieback stem seal until the no-go profile engages the tieback receptacle of the liner and a downhole portion of the tieback stem seal extends into the tieback receptacle;

the circulating sub is operable to pass kill fluid from the tieback assembly, through the circulating sub, and into the annular space of the wellbore when activated; and the check valve is operable to control a flow of fluid either through the tieback assembly or out of the circulating sub;

wherein the tieback stem seal comprises a plurality of seals around the tieback stem seal, the plurality of seals extending along the length of the tieback stem seal from the uphole end of the tieback stem seal to the downhole portion of the tieback stem seal on the downhole end of the tieback assembly, and where the method further comprises engaging the tieback stem seal with an interior surface of the tieback receptacle of the liner.

11. The tieback assembly of claim 10, where the tieback stem seal comprises at least one of the plurality of seals around the tieback stem seal along a length of the tieback stem seal, and the seal is operable to isolate the annular space of the wellbore.

12. The tieback assembly of claim 11, where the seal comprises a metal-to-metal seal or an elastomeric seal.

13. The tieback assembly of claim 10, where the check valve is operable to close and prevent upward fluid flow when the tieback stem seal is engaged into the tieback receptacle of the liner in the wellbore.

14. The tieback assembly of claim 10, where the check valve is a flapper valve.

15. The tieback assembly of claim 10, where the check valve further comprises a ball seat operable to catch a ball and direct the flow of fluid out of the circulating sub and into the annular space of the wellbore.

16. The tieback assembly of claim 10, where the check valve is positioned directly above the tieback stem seal and directly below the circulating sub.

17. The tieback assembly of claim 10, further comprising coiled tubing in fluid communication with the surface and the tieback assembly.

18. The tieback assembly of claim 17, where the coiled tubing is operable to pass kill fluid from the surface, into the tieback assembly, through the circulating sub, and into the annular space of the wellbore.

19. The tieback assembly of claim 10, further comprising one or more crossovers positioned between the tieback stem seal and the check valve, the check valve and the circulating sub, or both to connect tieback assembly components having different thread or connection types.

* * * * *